US005732827A

United States Patent [19]

Dorscht

[11] Patent Number: 5,732,827

[45] Date of Patent: Mar. 31, 1998

[54] SCREENING APPARATUS

[75] Inventor: John P. Dorscht, Union, Canada

[73] Assignee: Portec Inc., Oakbrook, Ill.

[21] Appl. No.: 398,068

[22] Filed: Oct. 25, 1995

[51] Int. Cl.[6] ..... B07B 1/18

[52] U.S. Cl. ..... 209/284; 209/288; 209/421

[58] Field of Search ..... 209/284, 285, 209/286, 288, 409, 420, 421

[56] References Cited

U.S. PATENT DOCUMENTS

| | | | |
|---|---|---|---|
| 5,002,656 | 3/1991 | Johansson | 209/421 |
| 5,301,813 | 4/1994 | Schmittjer | 209/288 X |
| 5,346,071 | 9/1994 | Page et al. | 209/420 X |

FOREIGN PATENT DOCUMENTS

| | | | |
|---|---|---|---|
| 2204506 | 11/1988 | United Kingdom | 209/288 |

*Primary Examiner*—Tuan Nguyen

*Attorney, Agent, or Firm*—R. Craig Armstrong

[57] ABSTRACT

The invention is a screening apparatus for classifying material of different sizes. A screen is rotatably mounted on a frame for rotation around a first axis which is angled upwardly away from the horizontal, at an angle of from 0 to 30 degrees. The screen is symmetrical about the axis and has an open upper inlet end and a lower outlet end. The screen has a cylindrical portion extending from the inlet end towards the outlet end, having a diameter larger than its length, and a conical portion extending from the cylindrical portion towards the outlet end, tapering inwardly to a central outlet opening, the lowest point of the outlet opening being substantially higher than the lowest point of the screen. The frame is pivotally mounted on a trailer for pivoting about a longitudinal axis near a lower side edge of the trailer. The open inlet end of the screen faces one side of the trailer. A screened discharge conveyor and an oversize conveyor carried the screened and oversized material, respectively, away from the screen.

9 Claims, 10 Drawing Sheets

SCREENING APPARATUS

BACKGROUND OF THE INVENTION

1. Field of the Invention

This invention relates to screening apparatus, to separate materials of different sizes or size ranges from each other.

Although the present invention clearly could be adapted for use in screening a wide variety of materials, the primary application for which it was designed is in classifying material by sizes, such as soils, compost, wood chips, aggregates, mixed waste or other debris in large scale operations. In composting operations, as one example, tub or tumble grinders are commonly used to break up waste such as bushes, shrubs, small trees, tree stumps, and other debris from large scale landscaping operations. The comminuted material is composted, and then passed through the screening apparatus to separate the larger material from the smaller finished product. The finished product may be use as mulch, top dressing, or topsoil. The larger material may be put through the grinder again, or may be composted further.

In any screening operation, to attain effective and efficient sizing and separation of materials, and some degree of uniformity in the end product, it is important to continuously agitate and move the material over the screen so that all or most of the material comes into contact with the screen. To make the method also practical for large jobs, it is important to continuously remove the larger sized material from the screening area, so that continuous processing is possible.

In order to constantly move the material over the screen, one method is to form the screen into a cylinder and to rotate the cylinder about a slightly inclined axis while the material is placed within the cylinder. By placing the cylinder at an angle, the material may be loaded at the elevated end, so that the material moves down the cylinder as it is screened and, at the other end, oversized material is discharged. By varying the angle of the elevation of the screening cylinder, different degrees of separation and commensurate speed of processing may be achieved. Such arrangements are known, although they typically involve relatively long and relatively small diameter cylinders. These are conventionally referred to as "trommel" screens.

These trommel screens must be long enough so that it takes the material some time to go through it; short cylinders would not separate the material effectively, as the material would quickly pour out from the lower end. At the same time, the cylinders must be made relatively small in diameter, so that they may be transported on the highway. Narrowing the cylinder however reduces the overall surface area of the screen, making the screening less effective.

Moreover, the typical trommel screen is difficult to load. A front-end loader cannot load the screen directly, due to its small diameter, so normally the material to be screened must be dumped into an input hopper and carried from there into the screen via an input conveyor. These additional components clearly add to the cost of the equipment, and produce additional ongoing maintenance requirements.

Another problem with these trommel screens is that controlling the rate of discharge and the quality of separation is difficult; even a slight change in the angle of elevation results in significant differences in the speed and quality of the screening. Therefore, such screens require more sensitive control, and greater monitoring by operators.

SUMMARY OF THE INVENTION

It is an object of the invention to provide screening apparatus which provides a large screening surface area, while having a short length and a wide diameter.

It is another object of this invention to provide screening apparatus which may be directly loaded, for example, by a front loader.

In the invention, therefore, a screen is rotatably mounted on support means for rotation around a first axis which is angled upwardly away from the horizontal. The screen is symmetrical about the axis and has an open upper inlet end and a lower outlet end. The screen has a cylindrical portion extending from the inlet end towards the outlet end, having a diameter larger than its length, and a conical portion extending from the cylindrical portion towards the outlet end, tapering down to a central outlet opening, the lowest point of the outlet opening being substantially higher than the lowest point of the screen.

Preferably, the angle of the first axis from the horizontal is variable up to an angle of at least 20 degrees from the horizontal, and preferably 0 to 30 degrees.

Preferably, the support means is a pivotable frame mounted on a trailer the second axis being a longitudinal axis near a lower side edge of the trailer, the first axis being in a transverse plane such that the open inlet end faces one side of the trailer.

Preferably, a screened discharge conveyor and an oversize conveyor carried the screened and oversized material, respectively, away from the screen.

This "choked" end permits a very short cylinder to be used, which in turn permits the lateral orientation on the trailer which permit direct loading from a front-end loader or the like.

Further features of the invention will be described or will become apparent in the course of the following detailed description. In the detailed description, the side of the trailer where material is loaded into the screen will be referred to as the near side, and the side where oversized material is discharged will be referred to as the far side.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
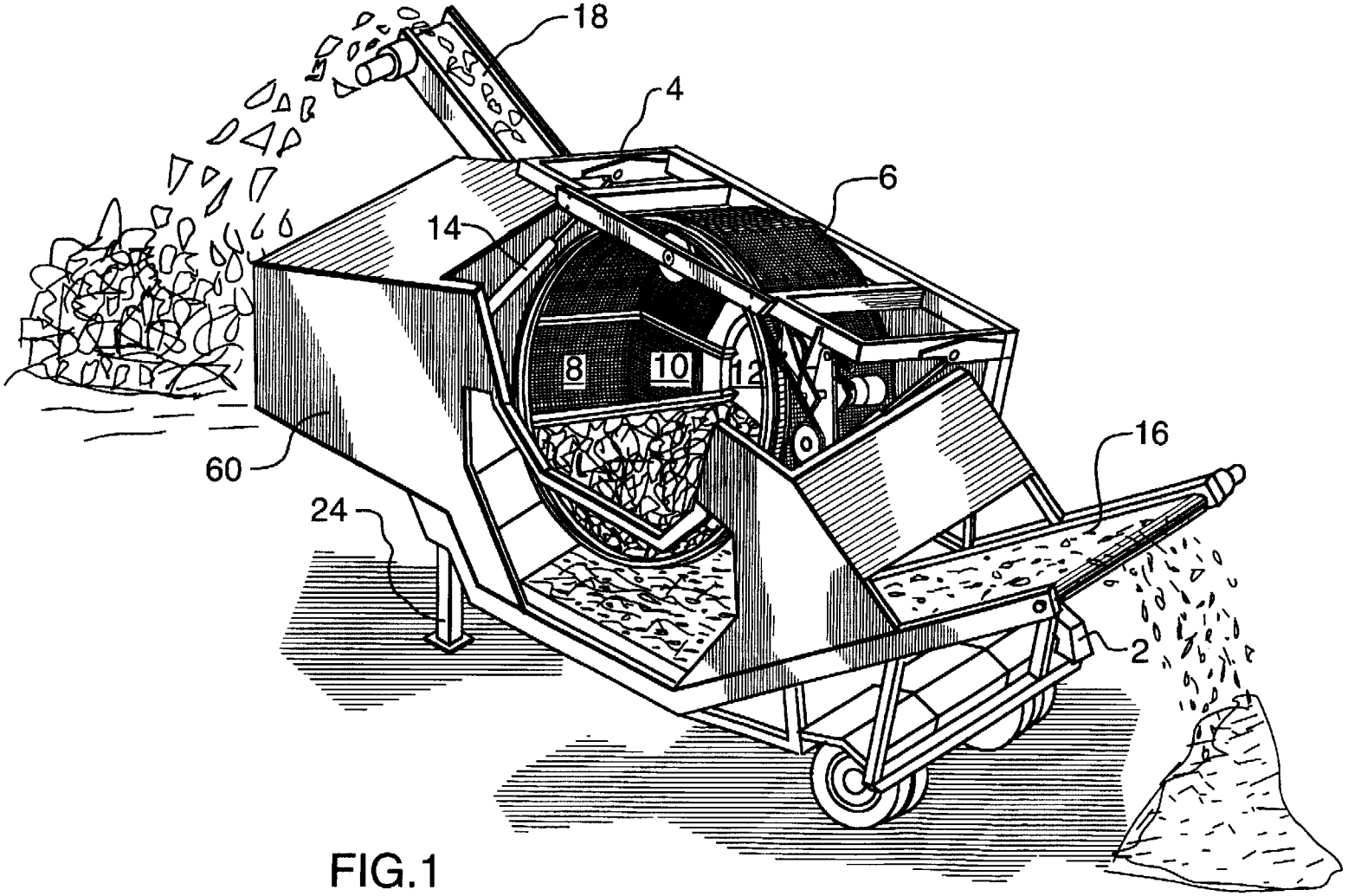
FIG. 1 is a perspective view of the preferred embodiment.
Figure 2:
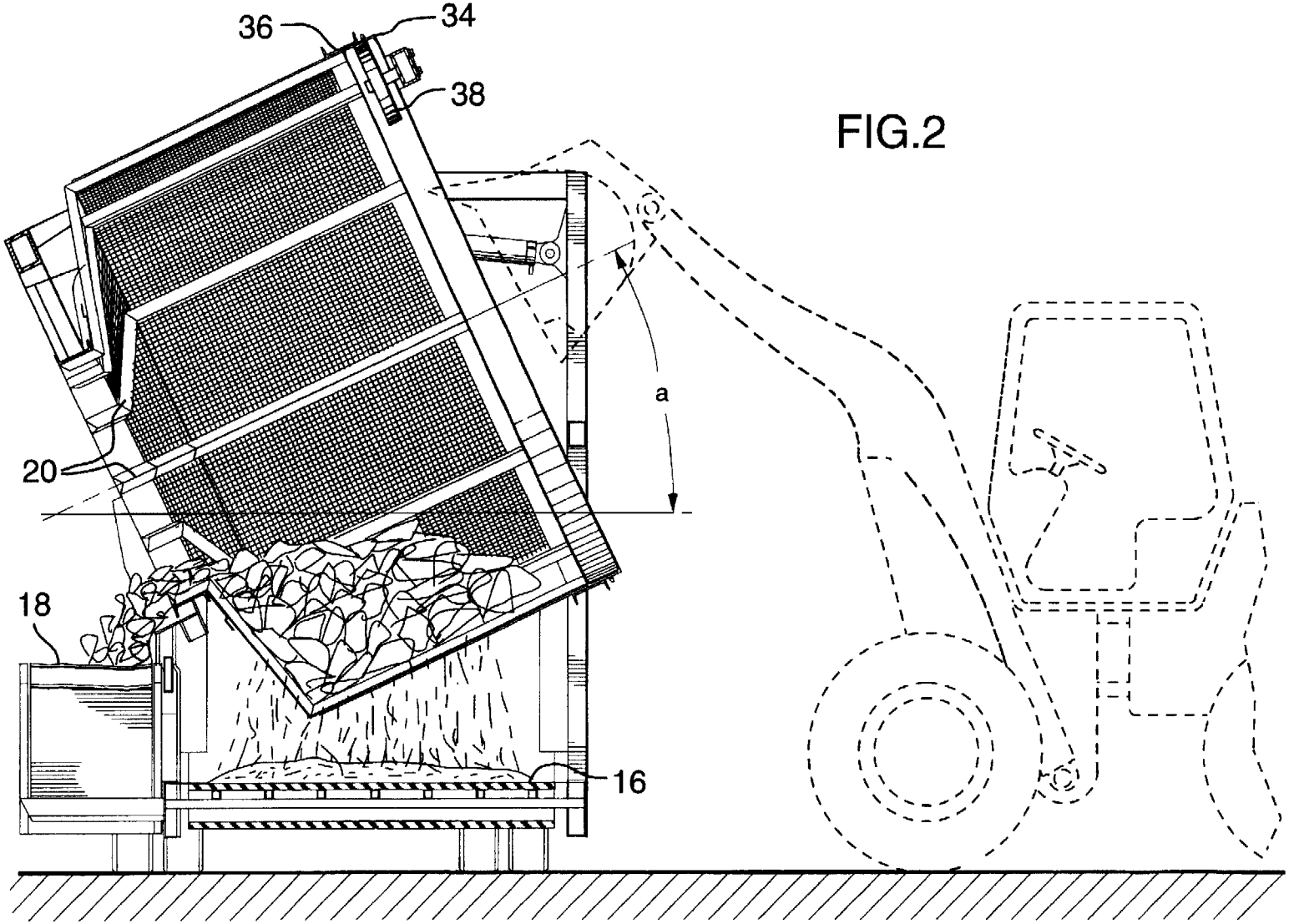
FIG. 2 is a cross-sectional view of the screen during operation and loading by a front end loader.
Figure 3:
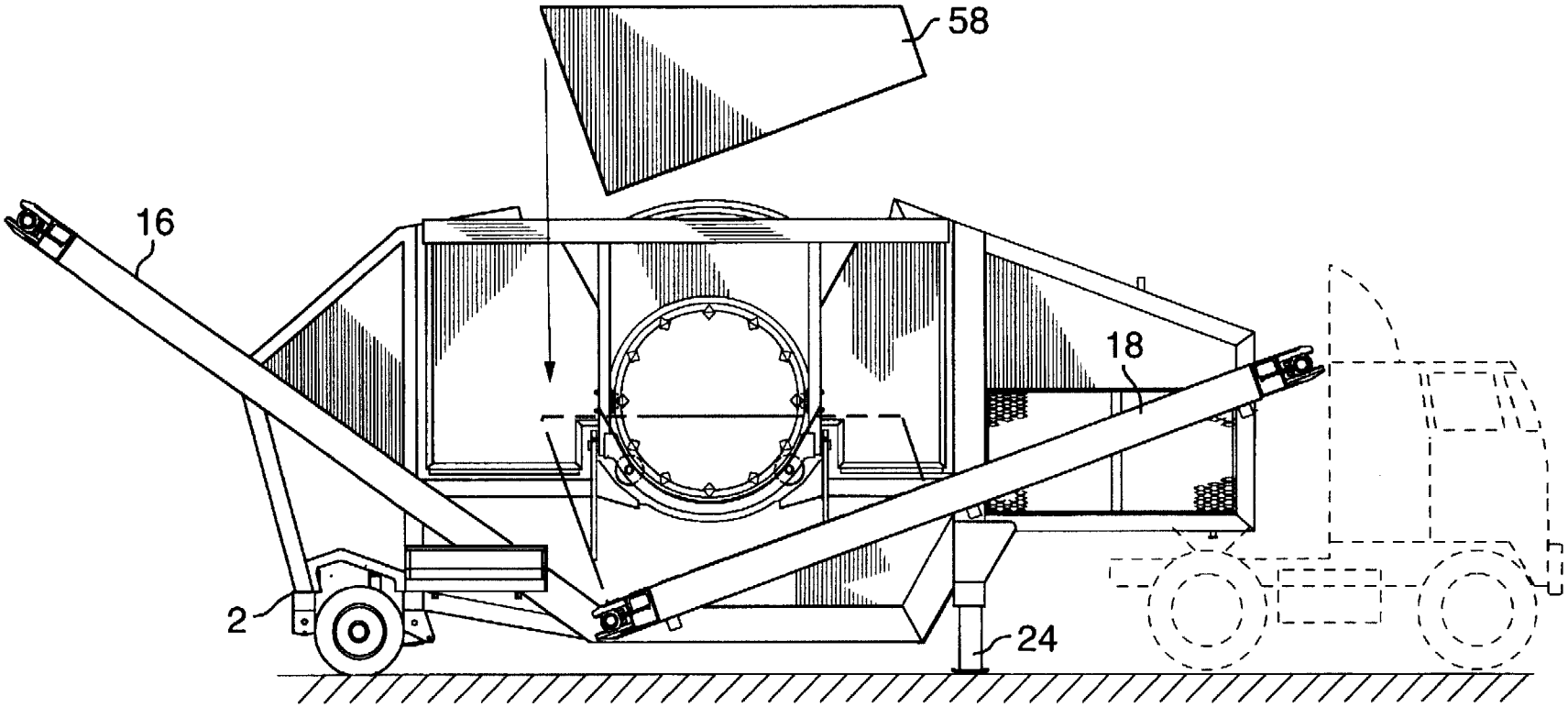
FIG. 3 is view of the far side of the equipment.
Figure 4:
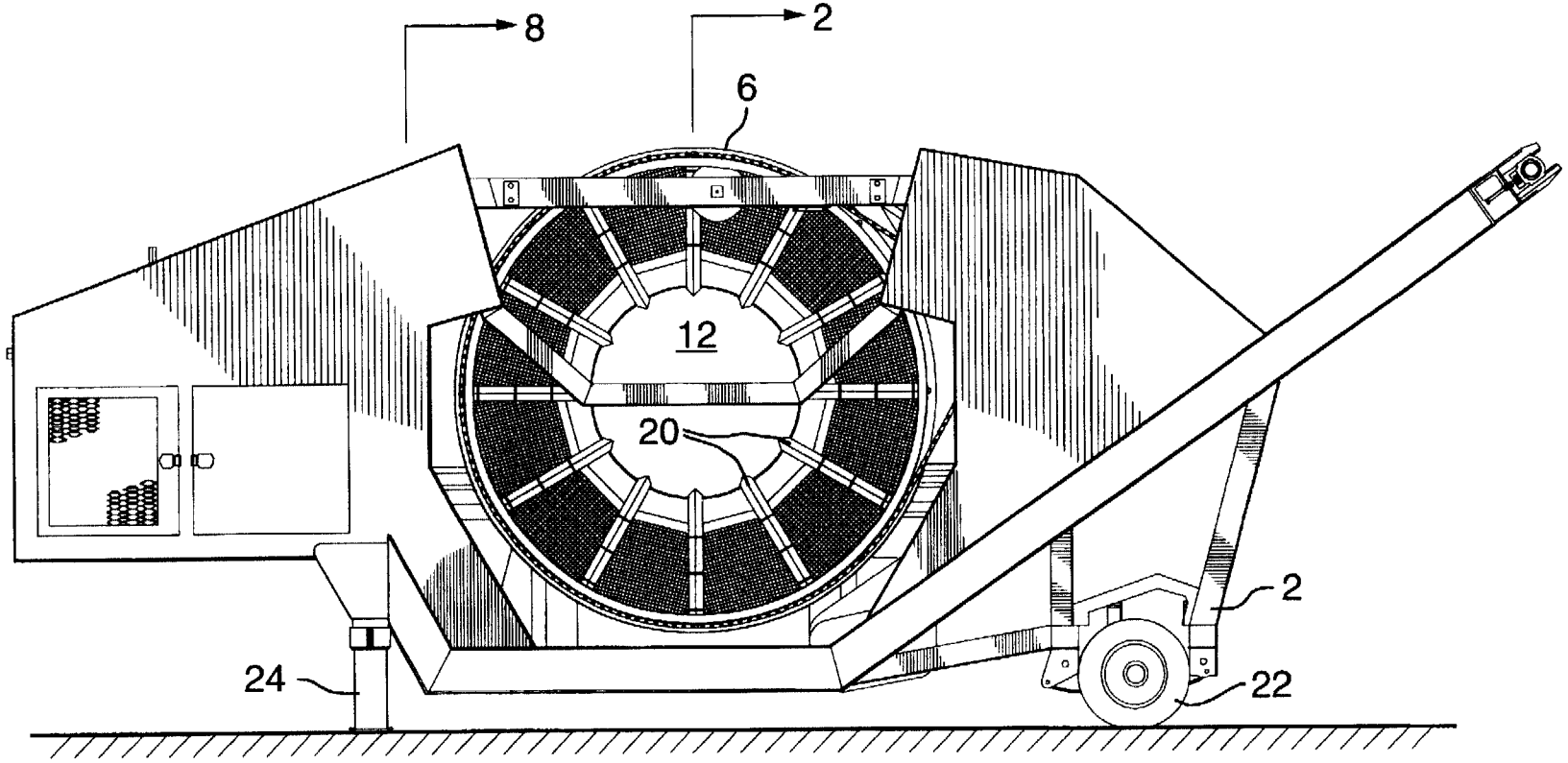
FIG. 4 is a view of the near side of the equipment.
Figure 5:
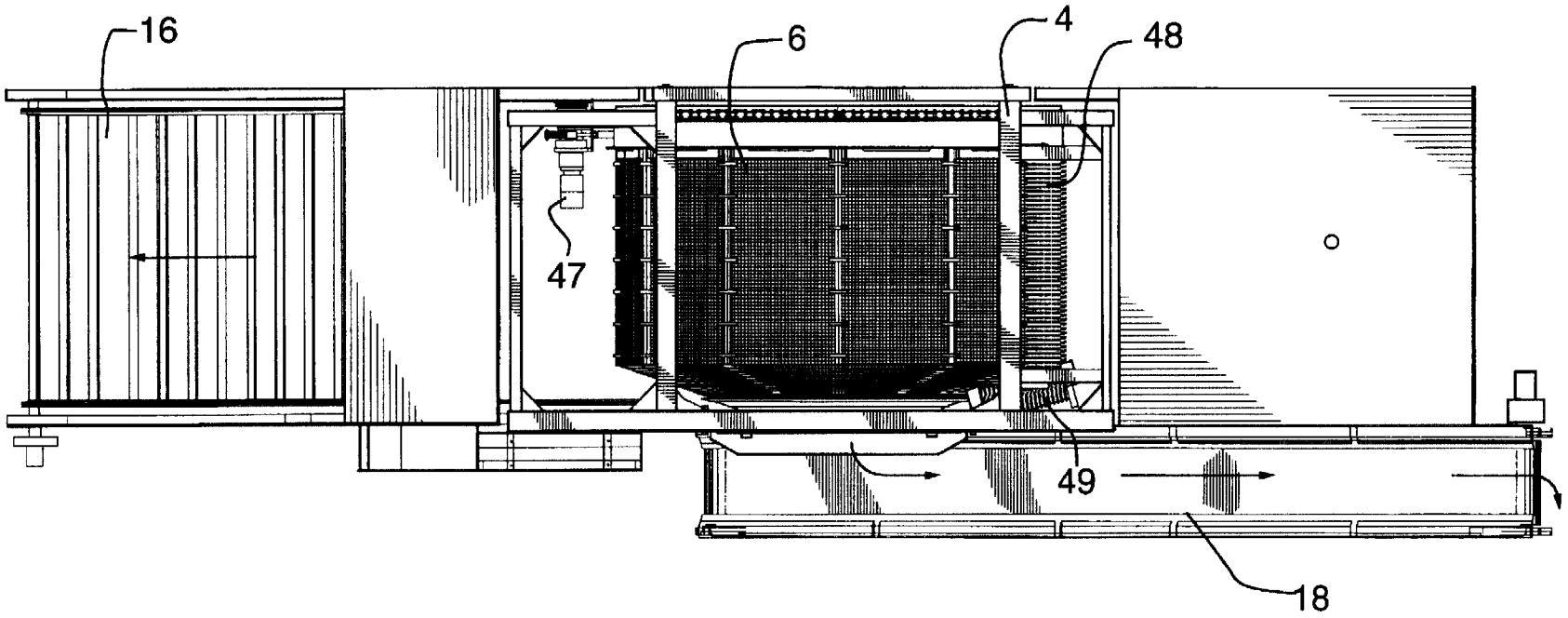
FIG. 5 is a top view of the equipment.
Figure 6:
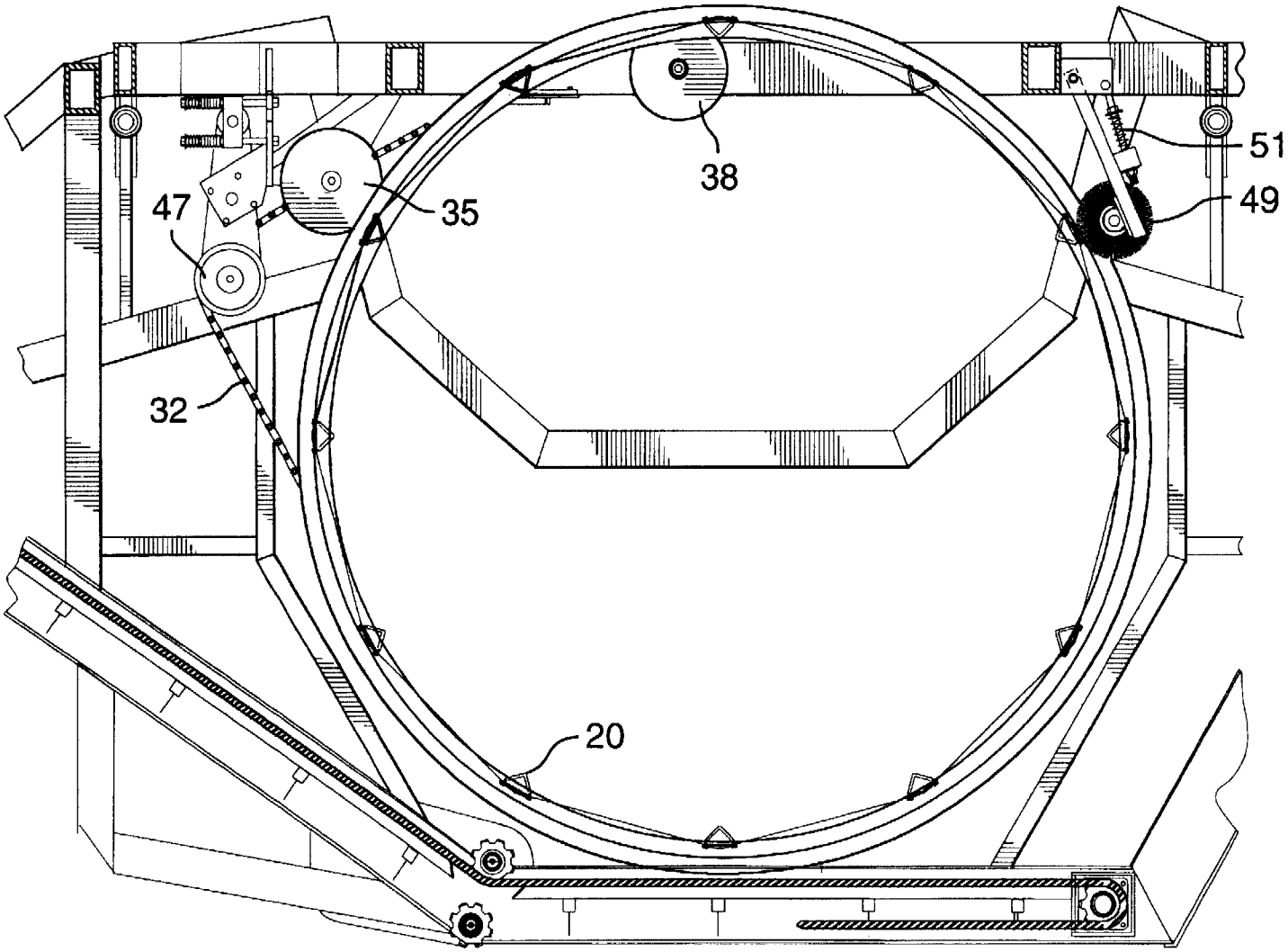
FIG. 6 is a cross-section of the screen, looking from the inside out toward the inlet opening.
Figure 7:
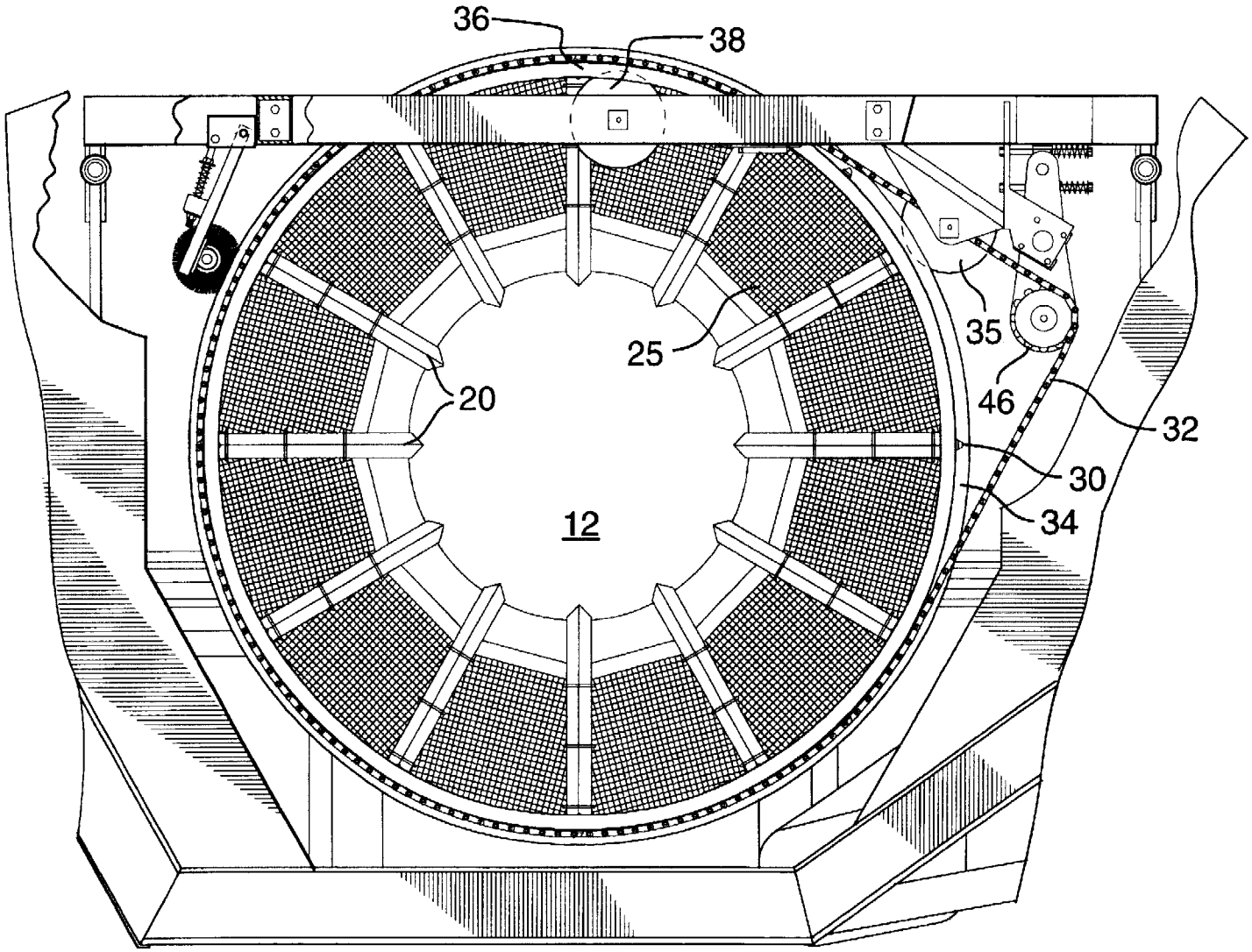
FIG. 7 is another cross-section of the screen, looking from the inside out toward the oversize outlet Opening.

The main components of the equipment, as can be seen in FIG. 1, are a trailer 2, with a pivotable frame 4 mounted thereon. The frame is mounted to pivot about a longitudinal axis near a lower edge of the trailer, as will be described in greater detail later. The frame supports a sidewardly-oriented rotating screen 6, which has a cylindrical portion 8; and a "choke" or conical portion 10 with a central outlet opening 12. Hydraulic cylinders 14 allow the angle of the frame, and thus the angle of the screen, to be varied relative to the trailer. A screened discharge conveyor 16 extends upwardly and rearwardly from under the screen, to discharge the screened material from a height at the rear of the trailer. A second conveyor 18, for oversized material, receives material from the central outlet opening 12, and carried it forwardly along the far side of the trailer.

It should be immediately noted that this configuration permits a large-diameter cylindrical portion of the screen to be used, into which the material may be loaded directly from the side of the trailer. The cylindrical portion 8 has a diameter of 11 feet, 6 inches in the preferred embodiment, which is more than large enough to receive the bucket of a front-end loader. This configuration provides a large screen area in a relatively small package.

The choke portion 10 of the screen prevents material from simply falling out the far side of the cylindrical portion, and itself screens the material, while providing sufficient dwell time for the debris to come into contact with the screen.

The screen has a series of internal ribs 20 which assist in tumbling the material more effectively, to ensure the desired contact with the screen, and to break up any small clumps of soil or other material. The large diameter of the cylindrical portion of the screen produces tumbling which is relatively more forceful and therefore more effective than in conventional smaller diameter screens. With rotation of the screen at typically up to 8 rpm, the debris rolls off the screen typically at the 10 o'clock or 2 o'clock position (depending obviously on the direction of rotation, and the larger diameter means that the debris falls a greater distance. At the same time, however, power requirements are reduced. For the same throughput, 50 horsepower in this unit should provide performance comparable to 80–150 horsepower in prior art units.

The hydraulic cylinders 14 permit the angle of the axis of the screen to be varied, to optimize performance for any given material, and for any given desired throughput rate or quality. In the preferred embodiment, a range of angles between 0 and 30 degrees from the horizontal is permitted. The zero degree angle is simply for highway travel, to minimize the overall height of the equipment. Most operations will be carried out in the range of 15 to 30 degrees, with approximately 25 degrees being the probable optimum for most jobs (based on testing of a scale model of the preferred embodiment). The 30 degree angle will be selected primarily when it is time to clean out the unit at the end of a job. In practice, the optimum angle may vary, and of course it may vary from job to job. It is a particular advantage of the invention that the angle may be varied readily, "on the fly", without having to take more extreme steps such as adjusting the levelling of the trailer (as is necessary with most trommel screen apparatus). This permits a unique degree of operator control over the oversize discharge.

In essence, then, the apparatus operates by tumbling the material in an angled rotating screen, which has a conical choke portion which also screens and which prevents oversize material from falling out the far side until the level reaches the oversize discharge opening 12. This permits a relatively short cylinder to be used, with a relatively large diameter, which in turn permits the cylinder to be oriented sideways, to receive material directly from a front-end loader or other external input means. The lowest point of the discharge opening is substantially higher than the lowest point of the screen, so that the material is in effect in a rotating trough. Preferably, the lowest point of the discharge opening is nearly at but slightly lower than the height of the lowest point of the inlet opening, i.e. the open end of the cylindrical portion.

The various elements of the preferred embodiment referred to above will now be described in greater detail.

At the rear end of the trailer is a single 20,000 lb. axle with dual wheels 22. At the front of the trailer is a fifth wheel attachment, and on each side, hydraulically extendible legs or "landing gear" 24.

In the preferred embodiment, the cylindrical and conical portions have 12 of the internal ribs 20. There are six replaceable screen panels 25, each preformed to cover two of the twelve cylindrical segments and two of the conical segments. The panels fit into channels 26 at opposite ends of the screen, and are secured by six edge strips 27 which are clamped onto the outside of the ribs by bolted brackets 28, to capture the panels between the strips and the ribs. Replacing the panels with panels having a different mesh size can be done relatively easily if a different output size is desired, although it is not contemplated that the screens would be changed with any great frequency. Although changing the screens is relatively easy, it cannot be accomplished in a matter of a few minutes. A typical mesh size in the preferred embodiment is one inch square, although obviously that can be varied widely to meet output requirements.

Outside the rim of the near side of the screen, i.e. the open cylindrical end, there are teeth 30 which receive a drive chain 32. On the same outer edge is a channel 34 for an outer positioning wheel 35. On the inside of the rim is another channel 36 for an inner positioning wheel 38. Outside the rim of the choked end, another channel 40 is located for two support wheels 42 on which the choked end of the drum sits, and two smaller positioning wheels 44 which prevent the screen from moving axially.

The drum is installed on the L-shaped frame 4 by hanging from the inside wide end placement wheel and resting on the choked end placement wheels. The drive chain 32 is routed around the chain teeth on the outside rim of the cylindrical portion and the sprocket 46 which is driven by a hydraulic motor 47. The tension on the chain, which is maintained by a tensioning mechanism 45, together with the weight of the drum, pulls the drum against the outer positioning wheel 35. This wheel and the two choked end small positioning wheels stop the screen from swinging side to side. The tension on the driving chain is maintained by the spring mechanism on which the driving hydraulic motor 47 is installed.

There are two cleaning brushes for cleaning and unclogging the screen's openings. One cleaning brush 48 is located outside the wide screening area. Another cleaning brush 49 is located on the conical portion. The brushes are kept in contact with the screen by respective spring mechanisms 50 and 51.

Figure 8:
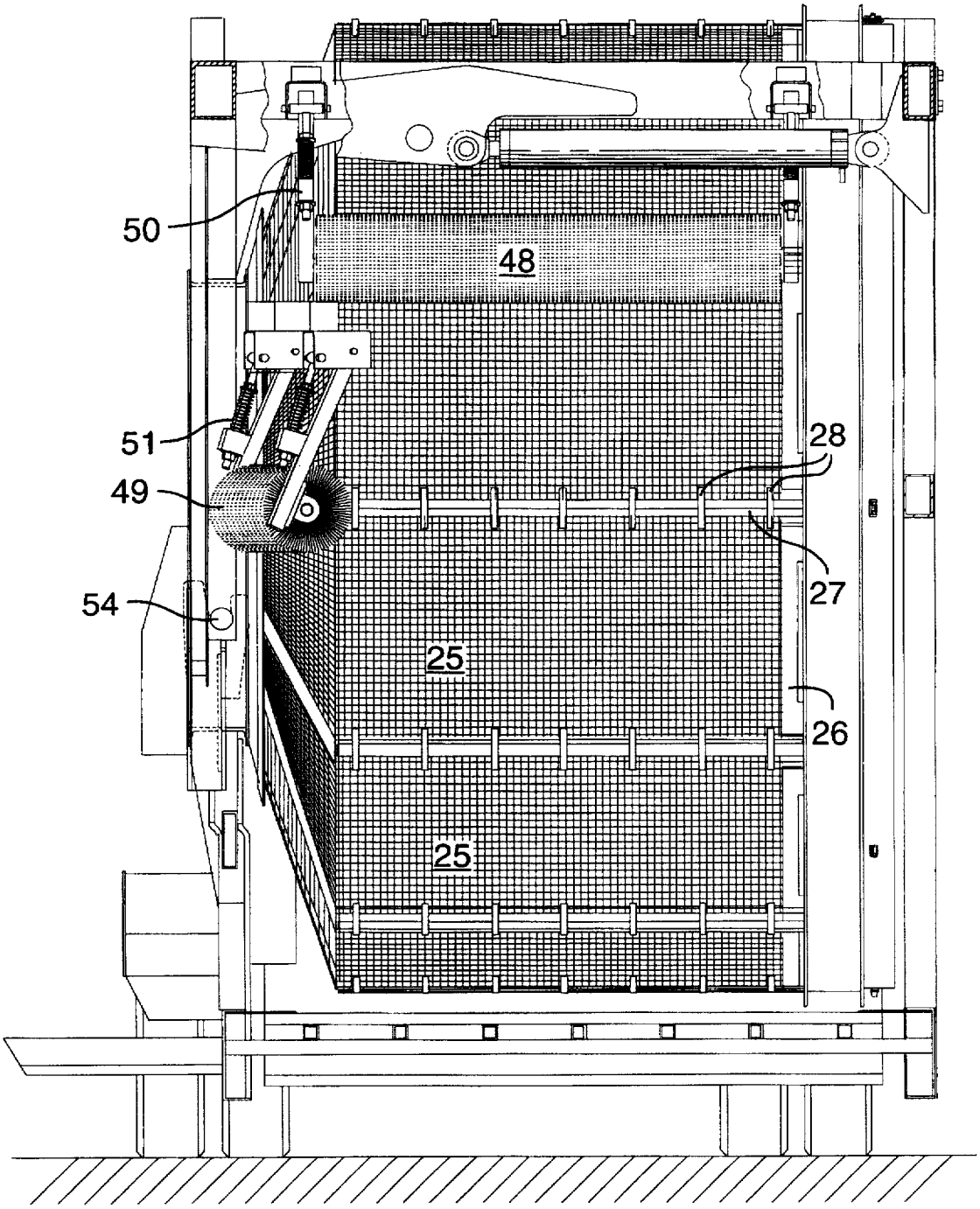
FIG. 8 is an end elevation view of the screen.
Figure 9:
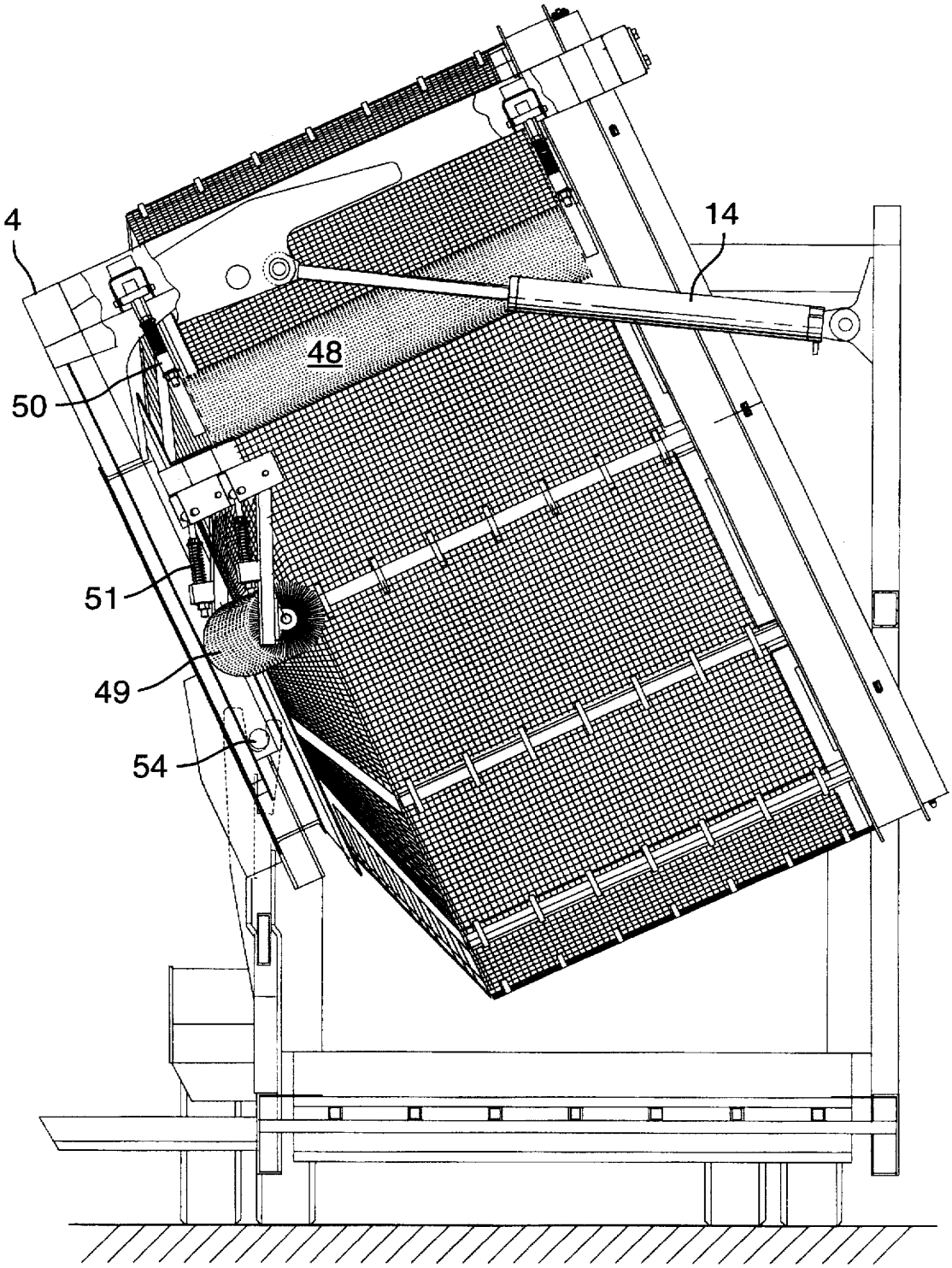
FIG. 9 is same as FIG. 8, with the screen at a 25° angle from the horizontal.
Figure 10:
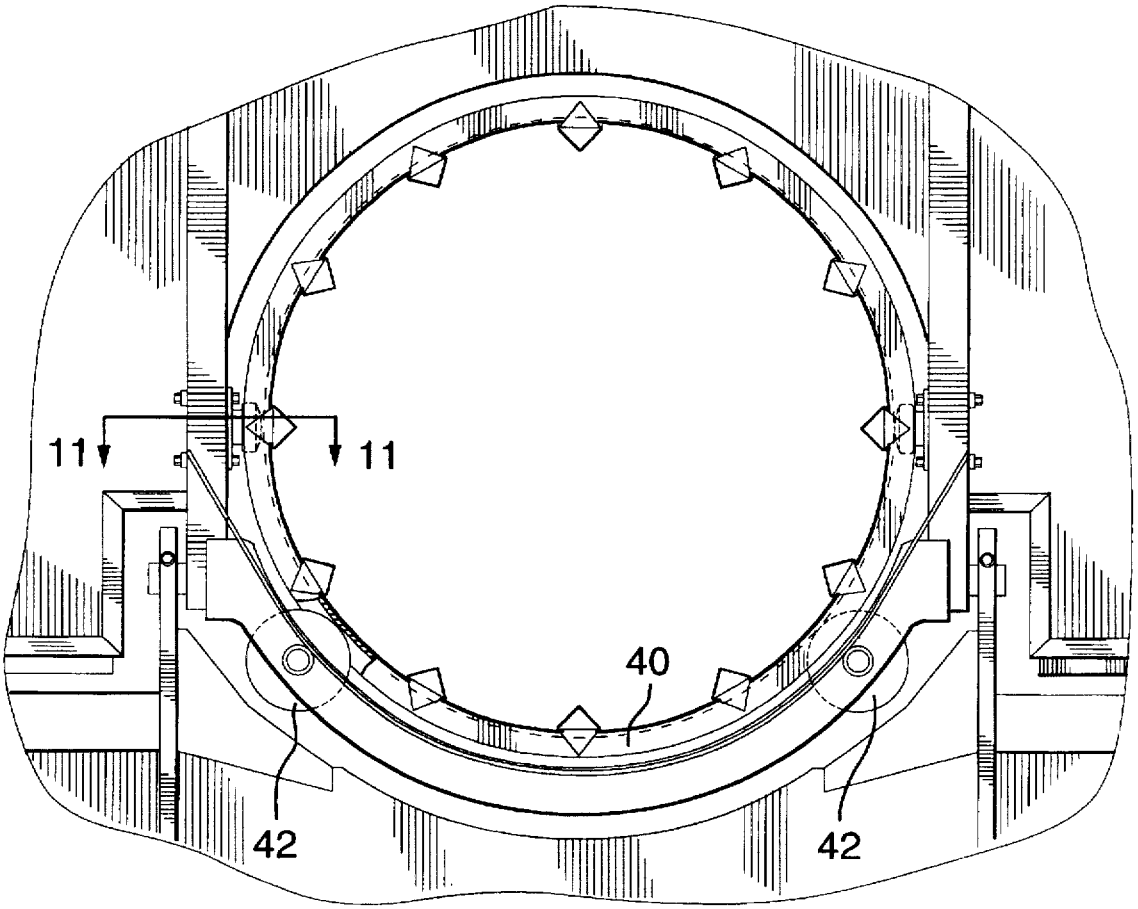
FIG. 10 is an elevation view from the far side of the trailer.
Figure 11:
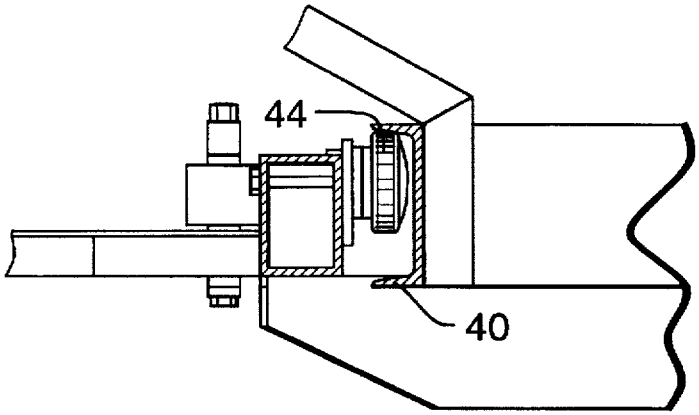
FIG. 11 is a cross-sectional view at 11—11 of FIG. 10.

The L-shaped frame 4 is pivotally connected to the main trailer frame, at the pivot points 54. The frame togetherwith the screen drum may be rotated on the pivot points by two hydraulic cylinders 14, up to a 30 degree angle. FIG. 8 shows the frame and screen at a zero degree angle relative to the trailer. FIG. 9 shows them at a 25 degree angle.

The discharge conveyer 16 extends the length of the screen and its length extends the width of the screen so that the conveyor captures all material which falls through the screen. The conveyor discharges at a height of 13 feet. The oversize conveyor 18, which is optional but preferred, is typically 24 or 48 inches wide, and discharges at a height of 9 feet. Where the choked end of the conveyor discharges on to the conveyor belt, a shield 58 is located on outer edge of the conveyor, extending upwardly, so as to ensure all oversize material falls on the conveyor. Both conveyors are driven by hydraulic motors which are located at the upper ends of the conveyors.

In the preferred embodiment, a 50 HP diesel engine powers the hydraulic pump for the various hydraulic motors in the invention. This engine is housed in the compartment 60 near the front of the trailer 2.

The overall length of the preferred embodiment is 37 feet; the width is 10 feet, 9 inches; the height is 13 feet, 5 inches; and the approximate weight is 30,000 pounds.

It will be appreciated that the above description related to the preferred embodiment by way of example only. Many variations on the invention will be obvious to those knowledgeable in the field, and such obvious variations are within the scope of the invention as described and claimed, whether or not expressly described.

For example, it should be apparent that although a trailer is referred to above, a permanent platform could be used instead, if transportation is not required.

Similarly, although it is highly desirable that the angle of the screen be variable, and preferably between 0 to 30 degrees from the horizontal, it should be apparent that a fixed-angle unit could still have some utility, although obviously not as versatile. It should also be apparent that some lesser degree of adjustability, or smaller angle such as 20 degrees, could still be useful although perhaps not optimum.

What is claimed as the invention is:

1. Screening apparatus, comprising:

supports means;

a screen rotatably mounted on said support means for rotation around a first axis which is angled upwardly away from the horizontal, said screen being symmetrical about said axis and having an open upper inlet end and a lower outlet end, said screen having a cylindrical portion extending from said inlet end towards said outlet end, having a diameter larger than its length, and a conical portion extending from said cylindrical portion towards said outlet end, tapering down to a central outlet opening, the lowest point of said outlet opening being substantially higher than the lowest point of said screen; and means for rotating said screen about said first axis.

2. Screening apparatus as recited in claim 1, where the angle of said first axis from the horizontal is variable up to an angle of at least 20 degrees from the horizontal.

3. Screening apparatus as recited in claim 1, where said support means comprises a pivotable frame mounted on a platform, pivotable about a second axis, said second axis being generally horizontal and perpendicular to said first axis.

4. Screening apparatus as recited in claim 3, where said platform is a trailer, and said second axis is a longitudinal axis near a lower side edge of the trailer, said first axis being in a transverse plane such that said open inlet end faces one side of the trailer.

5. Screening apparatus as recited in claim 4, where the angle of said first axis from the horizontal is variable up to an angle of at least 20 degrees from the horizontal.

6. Screening apparatus as recited in claim 4, where the angle of said first axis from the horizontal is variable up to an angle of at least 30 degrees from the horizontal.

7. Screening apparatus as recited in claim 4, where the angle of said first axis from the horizontal is variable between and angle of 0 degrees and an angie of at least 30 degrees from the horizontal.

8. Screening apparatus as recited in claim 4, further comprising a screened discharge conveyor extending upwardly and away from under said screen, to discharge the screened material from a height.

9. Screening apparatus as recited in claim 8, further comprising a second conveyor, for oversized material, receiving material from said outlet opening and carrying it away therefrom.

* * * * *